United States Patent [19]

Kato et al.

[11] 3,940,076

[45] Feb. 24, 1976

[54] APPARATUS FOR HANDLING A YARN END DURING A DONNING OPERATION ON A TEXTILE MACHINE

[75] Inventors: Takashi Kato, Kariya; Toshio Yoshizawa, Chiryu; Yasuo Yamada, Kariya, all of Japan

[73] Assignees: Daiwa Boseki Kabushiki Kaisha; Kabushiki Kaisha Toyoda Jidoshokki Seisakusho, both of Osaka, Japan

[22] Filed: Apr. 11, 1974

[21] Appl. No.: 460,086

[30] Foreign Application Priority Data

| | | |
|---|---|---|
| Apr. 16, 1973 | Japan | 48-42849 |
| May 11, 1973 | Japan | 48-52850 |
| June 1, 1973 | Japan | 48-62345 |

[52] U.S. Cl. ..... 242/18 R; 242/18 A; 242/18 DD; 242/35.5 A

[51] Int. Cl.[2] ..... B65H 67/04

[58] Field of Search ..... 242/18 R, 18 A, 18 DD, 242/35.5 R, 35.5 A

[56] References Cited

UNITED STATES PATENTS

| | | | |
|---|---|---|---|
| 3,429,514 | 2/1969 | Pospisil et al. | 242/18 A |
| 3,507,453 | 4/1970 | Scragg et al. | 242/18 R |
| 3,682,403 | 8/1972 | Willis | 242/18 A |
| 3,791,126 | 2/1974 | Kose et al. | 242/18 R UX |
| 3,820,730 | 6/1974 | Endo et al. | 242/35.5 R |

*Primary Examiner*—Stanley N. Gilreath
*Attorney, Agent, or Firm*—Burgess Ryan and Wayne

[57] ABSTRACT

Apparatus for handling yarn ends during a donning operation on a textile machine wherein in each operation unit, a yarn package is formed on a bobbin rotatably held by a cradle and rotated by the friction roller of a take-up mechanism. Just before or after doffing a full yarn package from the take-up mechanism, a yarn passage is formed by a yarn which is continuously supplied from the operation unit at a position in front of a part of the peripheral surface of the friction roller which the yarn passes over during the normal take-up operation. A fresh bobbin urges the yarn of the yarn passage toward the friction roller and then the fresh bobbin held by the cradle is rested on the friction roller. The yarn connected to the full yarn package is severed during the operation.

15 Claims, 34 Drawing Figures

APPARATUS FOR HANDLING A YARN END DURING A DONNING OPERATION ON A TEXTILE MACHINE

SUMMARY OF THE INVENTION

The present invention relates to an apparatus for handling a yarn end during a donning operation on a textile machine and, more particularly, relates to an apparatus for performing the donning operation while continuously delivering yarn produced by a textile machine wherein the yarn is wound on a bobbin mounted on a friction roller.

In the conventional textile machine where the yarn is wound on a bobbin mounted on a friction roller, if the yarn delivering operation is stopped and an auxiliary yarn is wound on a fresh bobbin mounted on the friction roller after doffing a full packaged bobbin from the friction roller, it is necessary to piece an end of the auxiliary yarn with the end of a fresh yarn delivered from a spinning part or delivery part of the textile machine. Consequently, the donning operation becomes very complicated.

To eliminate the above-mentioned complicated operation, several attempts have been made to carry out the donning operation without stopping the spinning or yarn supply operation from the delivery section of the machine to the winding mechanism. In these attempts, the yarn which is continuously delivered from the machine is introduced into a suction means or wound on a waste roller. However, the suction means or waste roller is disposed at a position between the winding mechanism and the delivery part of the textile machine. Consequently, the first winding of the yarn on a fresh bobbin is complicated. This is so because a yarn portion, which is held by holding means such as a suction nozzle, must be introduced into a nip line between the fresh bobbin and the friction roller in a relatively unstretched or slackened condition, after the connection with the holding means.

The principle object of the present invention is to provide an apparatus for performing the donning operation while continuously delivering a yarn from a delivery section of a textile machine, so as to eliminate the abovementioned drawbacks of the conventional donning method and apparatus.

To attain the purpose of the present invention, a portion of yarn taken up from a delivery part of the textile machine is passed beyond a peripheral surface of a friction roller at a point where the friction roller will be contacted by a winding bobbin. The yarn is then held by a holding means. The initial winding of yarn on the fresh bobbin is carried out by displacing an arm which rotatably holds the fresh bobbin in a position where it frictionally contacts the friction roller.

To effectively carry out the donning operation in the present invention, the full packaged bobbin is doffed from the winding mechanism by displacement of the bobbin to a discharge position. The yarn extending between the full bobbin and the delivery section of the textile machine is cut and the cut end of the yarn which is connected to the delivery section of the textile machine, is held by a suction means. Consequently, the so-called yarn retrieving operation can be eliminated.

Further objects and characteristic features of the present invention are clarified by the following detailed illustration of the embodiments with reference to the attached drawings and claims. The latter however, are not limited to the embodiments but are intended to cover modifications within the spirit and scope of the present invention.

DETAILED DESCRIPTION OF THE INVENTION

Figure 1:
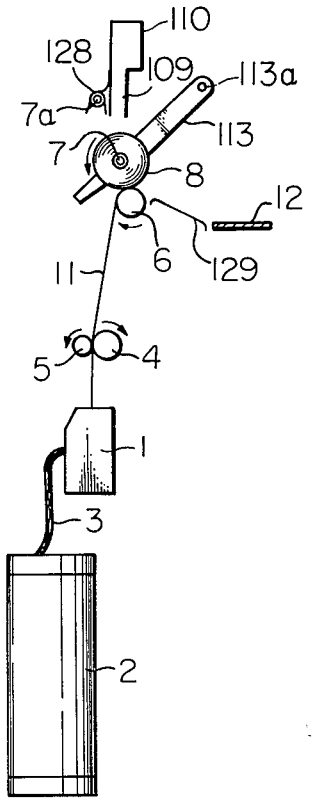
FIG. 1 through FIG. 6 are schematic side views of an embodiment according to the present invention, showing steps of a doffing and donning operation.

The apparatus according to the present invention may be utilized on a textile machine such as a yarn winder, a take-up machine in a mill producing filamentary yarn, an open-end spinning machine, etc. However, for the sake of clarity and simplicity in the following detaled illustration of the present invention, only the embodiments related to an open-end spinning machine are illustrated. In the following illustration of three different embodiments, the same elements in each of the embodiments are represented by identical reference numerals, and elements having similar functions in each of the three embodiments are represented by identical reference numerals having the numeral 100, 200 and 300 added thereto in the first, second and third embodiments, respectively.

Figure 19:
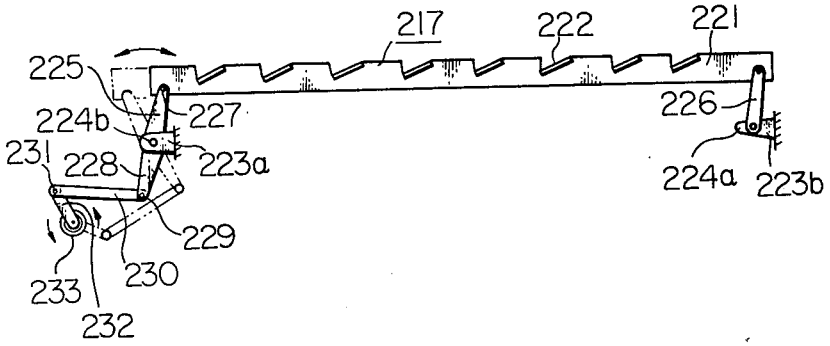
FIG. 19 is a front elevational view of a cutter utilized for the apparatus of the second embodiment.

Referring to FIGS. 1, 2, 3, 4, 5 and 6 wherein the steps of the doffing and donning operations of the first embodiment are shown, a silver 3 contained in a can 2 is supplied to an open-end spinning unit 1. A yarn 11 is delivered from the spinning unit 1 by means of a take-up force created by delivery rollers 4 and 5. The roller 4 is positively driven by a driving mechanism (not shown) while the roller 5 rotatably contacts the roller 4. The yarn 11 is then wound on a bobbin 7 by a take-up mechanism comprising a friction roller 6 and a bobbin holding cradle 113 which is rotatably mounted on a pivot shaft 113*a* such that the bobbin 7 is capable of contacting the friction roller 6 as shown. In this take-up mechanism, the friction roller 6 is a split drum which is positively driven by a driving mechanism (not shown) and provided with a yarn guide groove for traversing a yarn passage along a longitudinal axis of the bobbin, as shown in FIG. 19. The size of the yarn package formed on the bobbin 7 is increased by rotation of the bobbin 7 until a full yarn package 8 is formed by take-up of the yarn 11. Rotation of bobbin 7 is created by the frictional contact of the yarn package with the split drum 6. Then the full yarn package 8 is doffed from the above-mentioned winding mechanism and displaced to a conveyor belt 12 disposed lengthwise of the open-end spinning machine at a position adjacent to the winding mechanism of the spinning machine.

Figure 7:
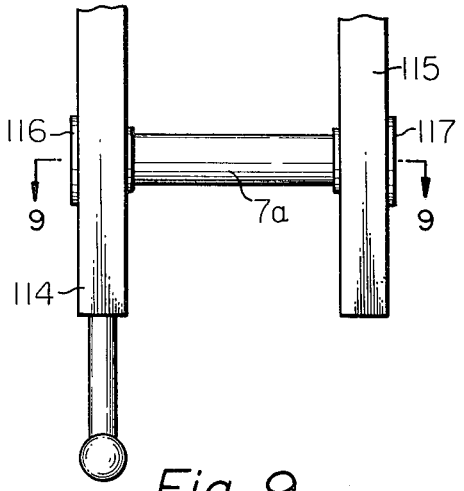
FIGS. 7 and 8 are schematic plan and side views, respectively, of a part of a cradle utilized for the open-end spinning unit according to the present invention.
Figure 8:
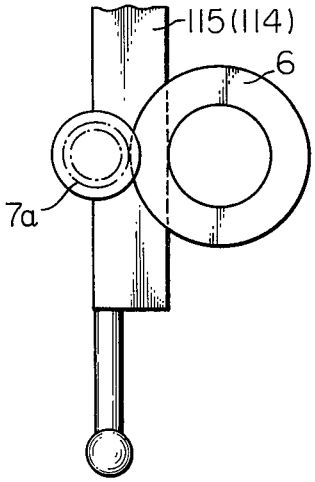
Figure 9:
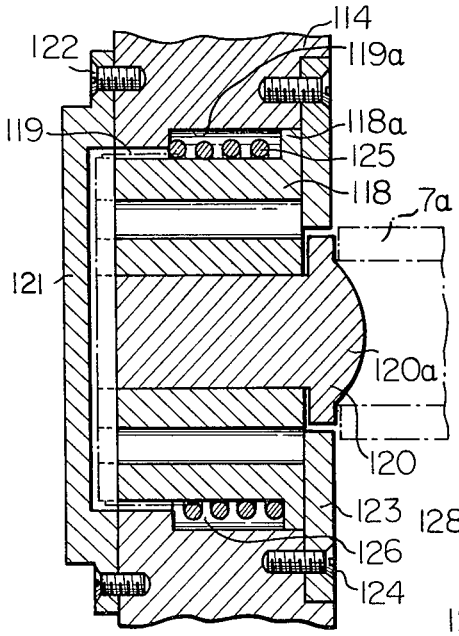
FIG. 9 is a sectional view of one of cradles taken along a line 9—9 in FIG. 7.
Figure 10:
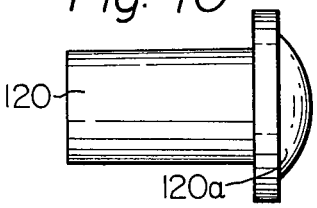
FIG. 10 is an elevational view of the bobbin holding member shown in FIG. 9.

The bobbin holding cradle 113 mentioned above comprises, as shown in FIGS. 7 and 8, a pair of parallel cradle arms 114 and 115 rotatably mounted on the pivot shaft 113*a* (FIG. 1) which is rigidly secured to a supporting means (not shown) which in turn is mounted to the frame of each spinning unit. The cradles arms 114, 115 are provided with bobbin catchers 116, 117 whereby a bobbin can be rotatably held. As the construction and function of the bobbin catcher 116 is similar to the bobbin catcher 117, the following illustration only relates to the bobbin catcher 116. Referring to FIGS. 9 and 10, the bobbin catcher 116 comprises a needle bearing 118 which is in splined engagement with a circular hollow space 119 formed in the cradle 114. A bobbin holding member 120 which is rotatably held by the needle bearing 118. The needle bearing 118 is provided with a laterally expanded flange portion 118*a* which is capable of sliding along the axial direction of the circular hollow space 119 at the laterally expanded portin 119*a*. A cover member 121 is rigidly mounted to the cradle 114 by set screws 122 such that the bearing 118 assembled with the bobbin holding member 120 is capable of being displaced into a space between the cradle 114 and an inside wall of the cover member 121. A ring shaped cover member 123 is rigidly mounted to the cradle 114 by set screws 124 such that the head portion 120*a* of the bobbin holding member 120 is capable of being displaced within an aperture formed in the ring 123. An expansion helical spring 125 is mounted on the needle bearing 118 in a cylindrical space 126 formed between the cylindrical surface 119*a* and the peripheral surface of the needle bearing 118 so that the needle bearing is always urged toward the head portion 120*a* along the axial direction of the bobbin holding member 120 and the head portion 120*a* is always urged outwardly from the outside surface of the ring shaped cover 123. The head portion 120*a* of the bobbin holding member 120 is provided with a partial spherical surface which is capable of being inserted into a cylindrical hollow formed in a fresh bobbin 7*a*. Consequently, if a fresh bobbin 7*a* is pushed into the intervening space between the head portions of the bobbin holding members of the bobbin catchers 116, 117, the above-mentioned head portions are first displaced toward the covers of the bobbin catchers 116 and 117 and then these head portions are inserted into the cylindrical space at the two end portions of the bobbin 7*a*. Consequently, the two ends of the fresh bobbin are rotatably caught and held by these bobbin catchers 116, 117.

In this embodiment, the cradle 113 is capable of turning upward from the split drum 6. A suction duct 110 is disposed above each take-up mechanism. A suction nozzle 109 is connected to the suction duct 110 is disposed above the cradle 113 directly above each take-up mechanism. Consequently, after doffing a full yarn package 8 from the bobbin catchers 116, 117, when the yarn 11 carried from the delivery rollers 4 and 5 is sucked into the suction nozzle 109, the yarn passes beyond the surface of the split drum 6 on the side where the yarn package normally contacts the split drum 6. A bobbin holder 128 is mounted to the bottom outside of the suction nozzle 109 so as to detachably hold the fresh bobbin 7*a* in such a condition, that, when the bobbin holding cradle 113 is turned toward the suction nozzle 109, the bobbin holding means comprising the bobbin catchers 116 and 117 arrives at the position of the bobbin holder 128. The fresh bobbin 7*a* is then automatically transferred from the bobbin holder 128 to the bobbin holding means of the cradle 113 simple by moving the cradle to position shown in FIG. 3.

Figure 2:
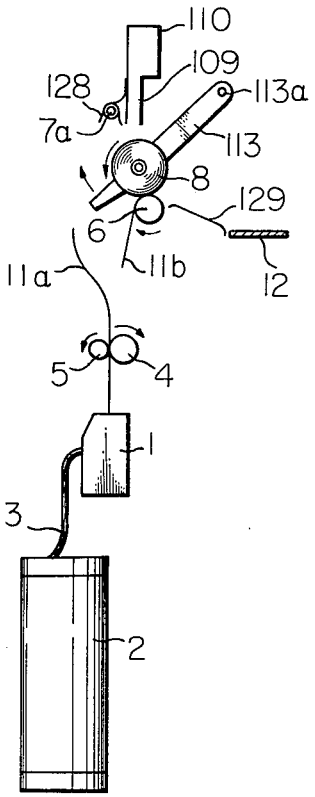
Figure 11:
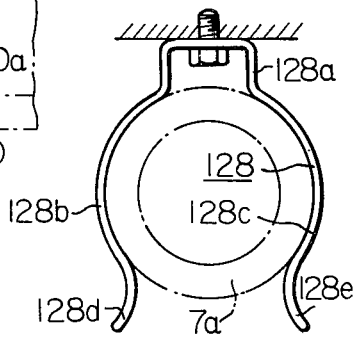
FIG. 11 is a front view of the bobbin holder shown in FIG. 1 through FIG. 6.

To clarify the above-mentioned bobbin transfer motion, the construction of the bobbin holder 128 is illustrated in more detail. Referring to FIG. 11, the bobbin holder 128 comprises a curved spring plate composed of an upside-down U-shaped top portion 128*a* which is secured to the suction tube 109 (FIG. 1), a pair of round portions 128*b*, 128*c* extended downward from legs of the reverse U-shaped top portion 128*a* and a pair of channel portions 128*d*, 128*e* extended downward from the round portions 128*b*, 128*c*, respectively. The space between round portions 128*b*, 128*c* coincides with a portion of the cylindrical outer surface of a fresh bobbin 7*a* while the intervened space between the channel portions 128*d* and 128*e* is so narrow that a fresh bobbin 7*a* held by the round portions 128*b*, 128*c* cannot freely fall down therethrough. However, if the fresh bobbin 7*a* held by the round portions 128*b*, 128*c* of the bobbin holder 128 is also held at its two axial ends by the holding means of the cradle 113 and pushed downward by displacing the holding means of the cradle 113 downward, the channel portions 128*d*, 128*e* are forced to expand so as to permit the escape of the fresh bobbin 7*a* from the holder 128. It is essential to dispose the bobbin holder 128 at a position where the fresh bobbin 7*a*, held by the bobbin holder 128, is capable of being caught at its two axial ends by the bobbin holding means of the cradle 113 when the cradle 113 is turned toward the suction nozzle 109. Consequently, when the cradle 113 is turned toward the suction nozzle 109 and the holding means of the cradle 113 comes to the position in the bobbin holder 128, each holding member of bobbin catchers 116 and 117 is firstly pushed into the aperture of the respective cradle 114 (115) when the fresh bobbin 7*a* contacts the head portion 120*a* of each bobbin holding member 120, and then the head portions 120*a* engage the axial hollow ends of the fresh bobbin 7*a*. In other words, the fresh bobbin 7*a* is held by the catchers of the cradle 113, after this fresh bobbin 7*a* is taken from the bobbin holder 128 by the turning of the cradle 113 toward the split drum 6. In this embodiment, it is further essential to dispose the bobbin holder 128 at a position on the suction nozzle 109 opposite and above both the path of yarn passage over the split drum 6 and the conveyor 12 (FIGS. 1 and 2). A guide plate 129 is disposed between the split drum 6 and the conveyer 12 so as to guide a full yarn package 8 to the conveyer 12.

Next, the donning operation according to the first embodiment is hereinafter illustrated in detail. In this embodiment, a fresh bobbin 7*a* is inserted into each bobbin holder 128 of each spinning unit before commencing the doffing operation as shown in FIG. 1.

When a full yarn package 8 has been formed on a bobbin 7, the doffing operation is commenced. An operator cuts the yarn 11 at a position between the delivery rollers 4, 5 and the take-up roller 6. The above-mentioned cutting operation is carried out manually or by using a suitable cutting apparatus. The yarn portion connected to the yarn package 8 is wound around the yarn package 8 and, if the above-mentioned operation is carried out manually, the end of the yarn connected to the yarn delivered from the delivery rollers 4 and 5 is held in the hand of the operator. Then after doffing the full yarn package 8 from the cradle 113, the cradle 113 is turned toward the suction nozzle 109 manually. (see arrow in FIG. 2)

Figure 3:
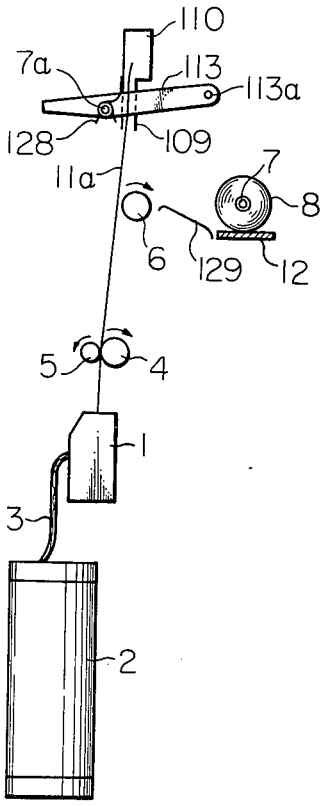

During the above-mentioned upward turning motion of the cradle 113, the full yarn package 8 rolls along a slope formed on the guide plate 129 toward the conveyor belt 12 and rests on the conveyor belt 12. The yarn 11 is continuously being delivered from the delivery rollers 4 and 5 and is carried to the suction nozzle 109 so as to be continuously sucked thereinto. (FIG. 3)

When the cradle 113 is turned to a terminal position of its upward turning motion, the bobbin catchers 116, 117 of the cradle 113 holds a fresh bobbin 7*a*, which is also being held by the bobbin holder 128 as already illustrated, while the yarn 11*a* continuously being delivered from the delivery rollers 4 and 5 is continuously sucked into the suction nozzle 109.

Figure 4:
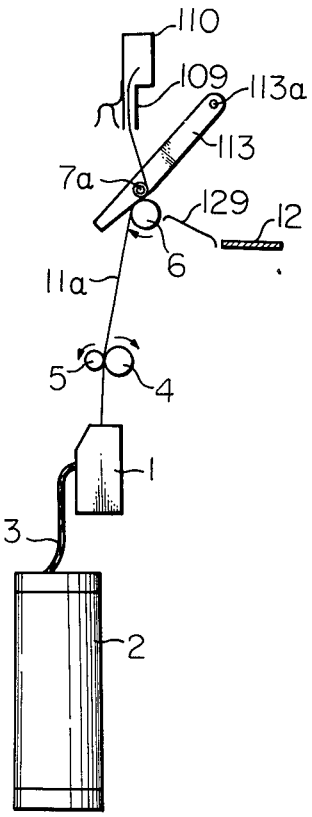

In the above-mentioned condition, the conveyor belt 12 carries the full yarn package 8 outside the open-end spinning machine. After that the yarn 11*a* is introduced onto the split drum 6 by the downward turning motion of the fresh bobbin 7*a*, which is rotatably held by the bobbin catchers 116, 117 of the cradle 113, and nipped by the fresh bobbin 7*a* and the split drum 6. (FIG. 4)

Figure 5:
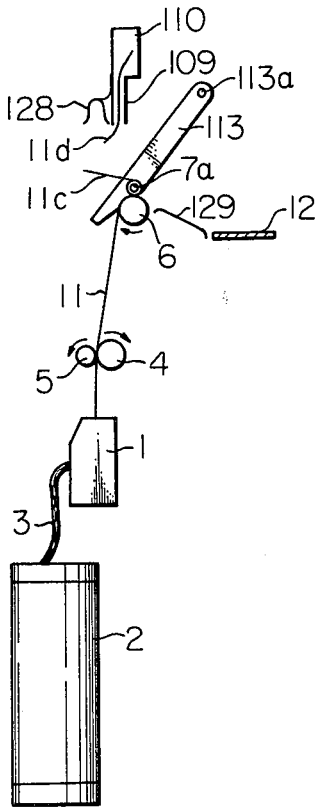

Next, the yarn 11*a* between the suction nozzle 109 and the fresh bobbin 7*a* is cut manually or by a suitable cutting device (not shown) into two portions 11*c* and 11*d*. The portion 11*d* extends from the suction nozzle 109, while the portion 11*c* extends from the fresh bobbin 7*a*. The yarn portion 11*d* is sucked into the suction nozzle 109, while the portion 11*c* of the yarn 11*a* falls on the fresh bobbin 7*a* so that the yarn portion 11*d* is wound on the bobbin 7*a* due to the rotation of the bobbin 7*a* (FIG. 5).

Figure 6:
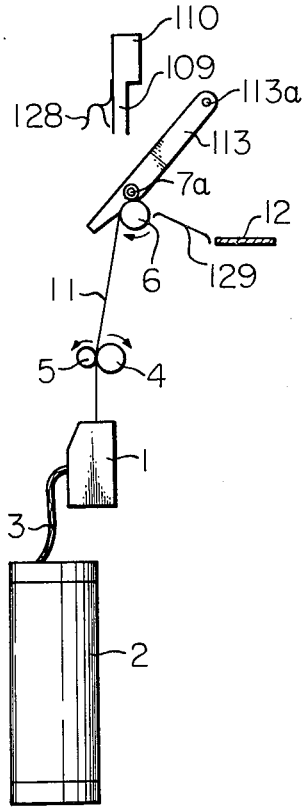

The winding of yarn portion 11*d* on the bobbin 7*a* sets the yarn on the bobbin for the commencement of the bobbin winding operation (FIG. 6).

In the above-mentioned embodiment, the suction of the suction duct 110 may be actuated only at the time of carrying out the above-mentioned doffing and donning operation. Further, the conveyor belt 12 may be omitted, in which case a reserve box or carrier for temporarily storing the full yarn packages may be utilized. If the above-mentioned bobbin holder 128 is omitted from the open-end spinning machine, a fresh bobbin 7*a* is mounted on the cradle 113 while the cut-end of the yarn 11*a* is continuously sucked into the suction nozzle 109, so that the fresh bobbin 7*a* pushes the yarn 11*a* toward the split drum 6.

Next, the construction and function of the second embodiment is hereinafter illustrated in detail. In this embodiment, when a full yarn package is displaced from the take-up mechanism to the conveyer belt, the operation of cutting yarn between the take-up mechanism and the conveyer is automatically carried out. The yarn which is continuously delivered from the delivery rollers of the spinning unit is continuously held in a condition such that the continuously delivered yarn passes along the position of the periphery of the round surface of the split drum which is contacted by a fresh bobbin or yarn package during the take-up operation.

Figure 12:
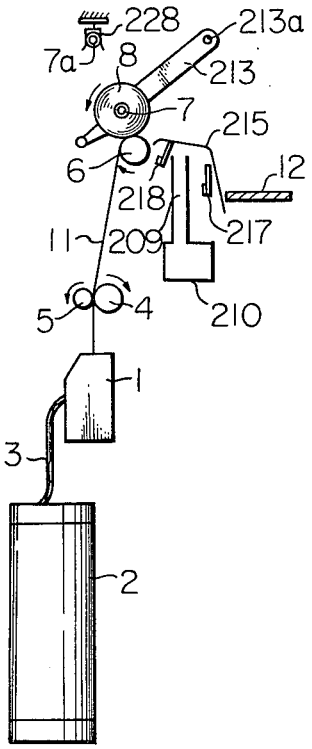
FIG. 12 through FIG. 14 are schematic side views of a second embodiment according to the present invention, showing steps of a doffing operation and the initial steps of a donning operation.
Figure 13:
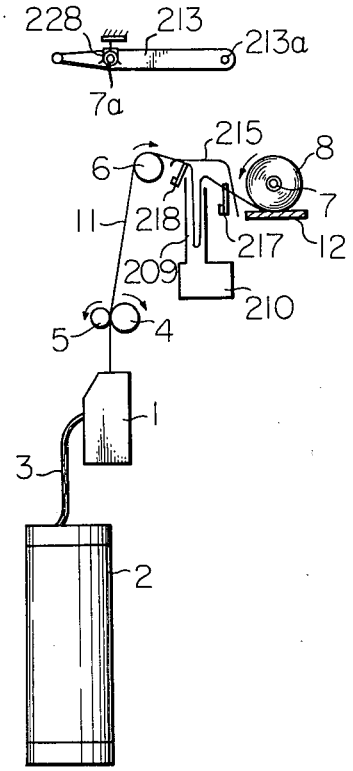
Figure 14:
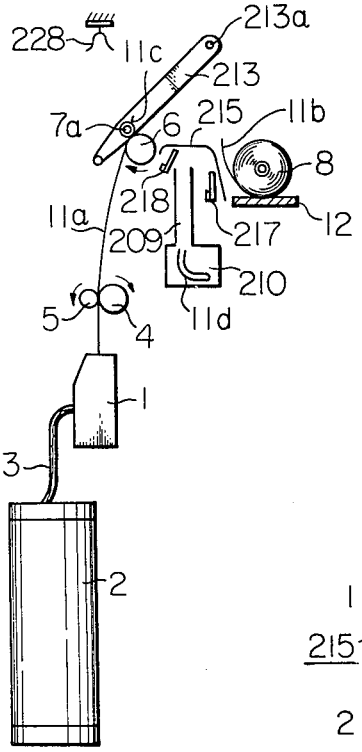
Figure 18:
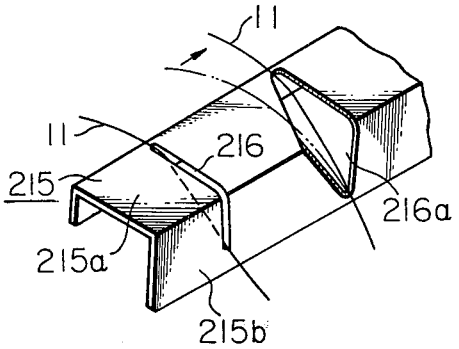
FIG. 18 is a perspective view of a guide plate for defining a yarn passage in the apparatus of the second embodiment.

Referring to FIGS. 12, 13 and 14, a cradle 213 has a construction similar to the cradle 113 shown in the first embodiment. At a position above the cradle 213 a bobbin holder 228, which has a construction similar to the bobbin holder 128, is disposed. The relative position of the bobbin holder 228 to the bobbin catcher (not shown) of the cradle 213 is similar to the first embodiment. Therefore, when the cradle 213 is turned upward about a shaft 213*a*, and the cradle 213 comes to the terminal position of its upward turning motion, a fresh bobbin 7*a* held by the bobbin holder 228 is also caught by the bobbin catcher (not shown) of the cradle 213. Then when the cradle 213 is turned downward toward the split drum 6, the bobbin 7*a* is released from the bobbin holder 228 and held only by the above-mentioned bobbin catcher. A modified guide plate 215 is disposed between the take-up mechanism and the conveyor belt 12. As shown in FIG. 18, the guide plate 215 is provided with a slit 216 and a suction nozzle 209 (FIGS. 12, 13 and 14) is disposed right below the slit 216. The suction nozzle 209 is connected to a suction duct 210. A pair of cutting devices 217 and 218 are disposed at the positions outside of the suction nozzle 209 shown in the drawings. That is, the cutting device 217 is disposed between the suction nozzle 209 and the conveyor belt 12, so that a yarn 11 connected to a full yarn package 8 carried to the conveyer belt 12 is cut, while the cutting device 218 is disposed between the suction nozzle 209 and the split drum 6, so that a yarn 11 from the split drum 6 is cut. To carry out the above-mentioned cutting operation without failure, it is necessary to introduce the yarn 11 into the slit 216. To attain the above-mentioned condition, the shape of the guide plate 215 and the disposition of the slit 216 are of particular importance. That is, a plate having a reverse U-shaped lateral cross section is utilized for the guide plate 215 and the slit 216 formed on the flat portion 215*a* extends to one of the leg portions 215*b*. Consequently, when the yarn is introduced into the slit 216, the yarn passes along a straight passage between the two terminals of slit 216, which passage lies under the flat portion 215*a*. Further, the suction force of the suction nozzle 209 is preferably applied to the slit 216 to aid in moving the yarn 11 to the slit 216 through either by the traverse motion of the split drum 6, or the motion of the conveyer belt 12 which displaces the full yarn package along the longitudinal direction of the guide plate 215. As shown in FIG. 18, the slit 216 may be modified to take the shape of the slit denoted by numerals 216*a*.

Figure 20:
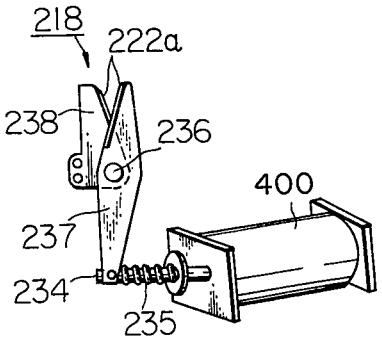
FIG. 20 is a front elevational view of a modification of the cutter sohown in FIG. 19.

The detailed construction of the above-mentioned cutting devices 217 and 218 are shown in FIGS. 19 and 20. The cuttng knives 222 of the cutting device 217 are mounted on a horizontal bar 221 that each cutting knife 222 is disposed adjacent to each spinning unit. These cutting knives 222 may be mounted as a single body or separately on the bar 221. The bar 221 is supported by a pair of arms 225, 226 which are pivotably mounted on pivot shafts 224*a*, 224*b*. Arms 225, 226 are mounted on brackets 223*a*, 223*b*, the arm 225 being connected to a crank shaft 233 via levers 230 and 232 so that the arm 225 is capable of reciprocally swinging between the positions represented by a solid line and a broken line. In the above-mentioned embodiment, reference numerals 227, 229, 231 are connecting pins while the reference numeral 228 represents an extended portion of the arm 225. The above-mentioned reciprocal pivoting motion is created by the crank motion of the lever 232. This reciprocal pivoting motion, together with the up and down motion of the cutting device 217, moves the yarn 11 along and in contact with the knife edge and toward the knife. Consequently, the cutting operation of the yarn 11 can be carried out without failure. Referring to FIG. 20, the cutting device 218 comprises a stationary cutting knife 238 and a movable cutting knife 237 whereby a scissors type cutter is formed. The movable knife 237 is actuated by a solenoid 400. That is, the knife 237 is rotatably mounted on a pivot shaft 236, and the bottom end portion of the knife 237 is connected to a plun ger 234 of the solenoid 400. A helical spring 235 is mounted on the plunger 234 so as to assist the return motion of the plunger 234.

Figure 15:
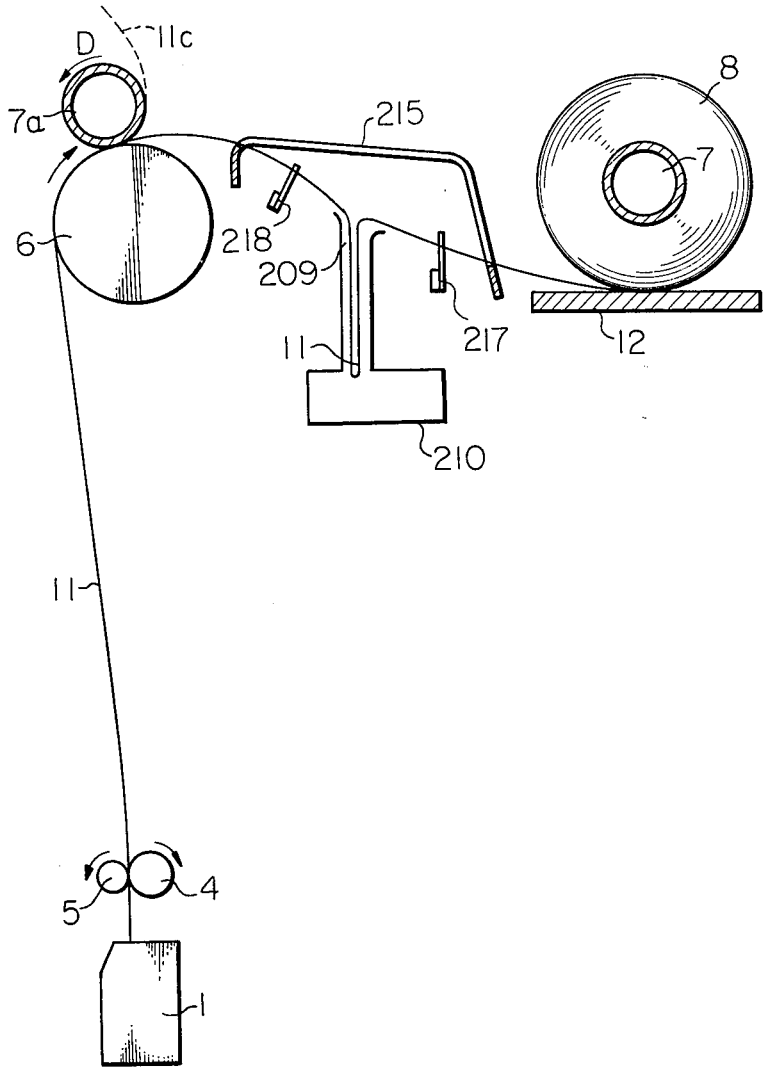
FIG. 15 is a schematic side view of the apparatus of the second embodiment wherein the operation for cutting a yarn between a full packaged bobbin displaced from a friction roller and a full yarn package is shown.
Figure 16:
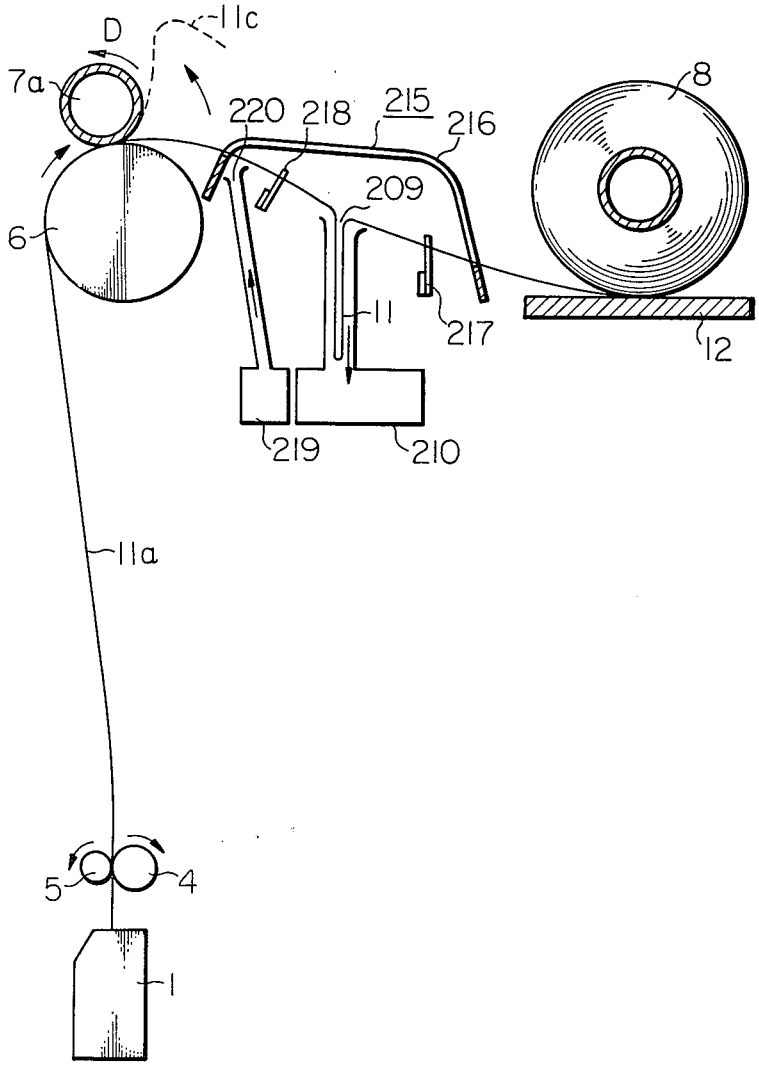
FIG. 16 is a schematic side view of the apparatus of the second embodiment, wherein a blowing nozzle utilized for leading a cut-end of the yarn toward a fesh bobbin is shown.

In the above-mentioned embodiment, either one of the cutting devices 217 and 218 may be actuated before the other, or both of cutting devices 217 and 218 may be actuated simultaneously. The cutting operation is carried out after the fresh bobbin 7*a* held by the cradle 218 contacts the split drum 6. It is of course required that the yarn portion 11*c* extending from the split drum 6 be wound upon the fresh bobbin 7*a*. When shown in FIG. 15, as the cutting device 218 is actuated the yarn 11 between the split drum 6 and the suction nozzle 209 is tensioned. Thus, the yarn portion 11*c* tends to jump towards the fresh bobbin 7*a*. However, to assure that the cut yarn portion 11*c* comes into contact with the fresh bobbin 7*a*, it is preferable to utilize an auxiliary blowing nozzle 220. Blowing nozzle 220 is connected to a blowing duct 219 as shown in FIG. 16. In FIG. 16, the blowing nozzle 220 which is connected to the blowing duct 219 is disposed between the split drum 6 and the cutting device 218 at a position just below the slit 216. Consequently, if the blowing nozzle 220 is actuated simultaneously with the actuation of the cutting device 218, the yarn end portion 11*c* is urged toward the fresh bobbin 7*a* by the blowing force created by the nozzle 220 and by its natural tendency to jump toward the fresh bobbin 7*a*. When the yarn end portion 11*c* comes into contact with the fresh bobbin 7*a*, which is turning in the direction indicated by arrow D, the yarn end portion 11*c* can be easily picked up by the fresh bobbin 7*a*.

Figure 17:
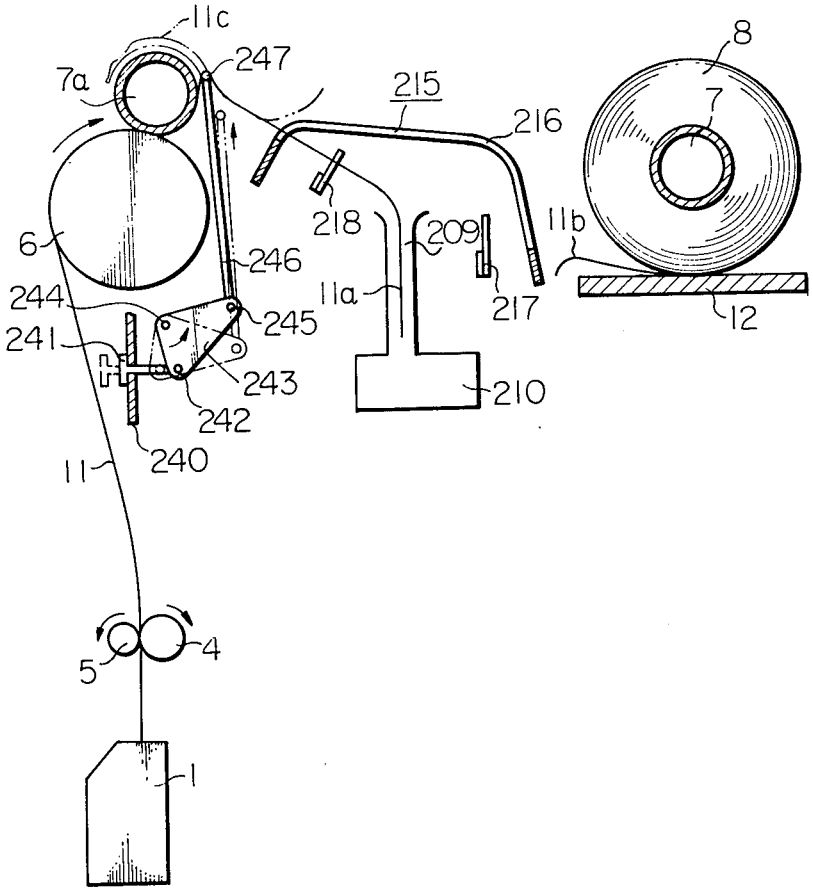
FIG. 17 is a schematic side view of the apparatus of the second embodiment, wherein a modified means for leading a cut-end of the yarn toward a fresh bobbin is shown.
Figures 21, 22:
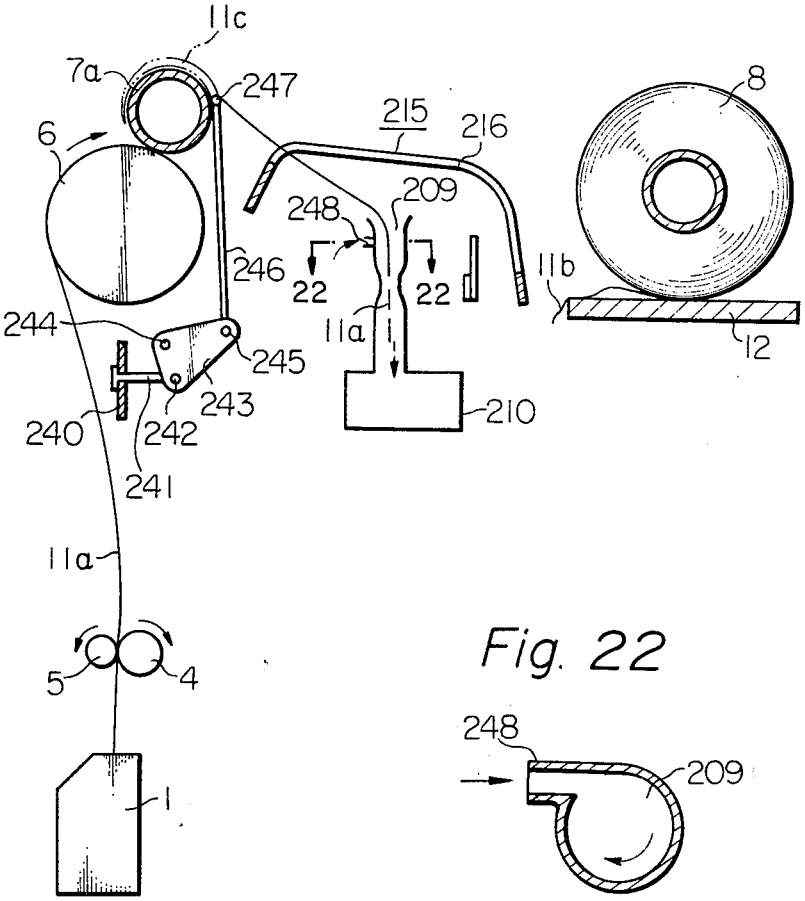
FIG. 21 is a schematic side view of a modification of the apparatus shown in FIG. 17, wherein a suction nozzle for catching a cut-end of the yarn which is connected to a full packaged bobbin is provided along with an auxiliary cutter.
FIG. 22 is a cross-sectional view of the suction nozzle shown in FIG. 21, taken along a line 22—22 in FIG. 21.
Figure 23:
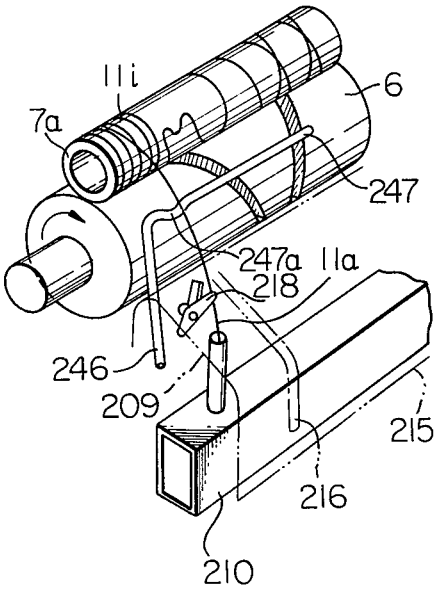
FIG. 23 is a perspective view of a part of the apparatus of the second embodiment, wherein means for forming a transfer tail wind on a fresh bobbin is provided.

A mechanical means for introducing the yarn end portion 11*c* to the split drum 6 is shown in FIGS. 17, 21 and 23. Referring to FIG. 17, a rod 246 provided with a yarn receiver 247 is connected to a push rod 241 via a swing plate 243. The swing plate 243 is swingably mounted on a bracket (not shown) by a pivot shaft 244. The lower end of the rod 246 is connected to the swing plate 243 by a connecting pin 245, while the push rod 241 is slidably mounted in a guide aperture in bracket 240. Bracket 240 is in turn secured to a machine frame (not shown) and connected to the swing plate 243 by a connecting pin 242. The rod 246 is capable of being displaced upward by pushing the rod 241 from a first holding position represented by a broken line to a position represented by a solid line in FIG. 17, while the rod 246 and the swing plate 243 are capable of being displaced downward by their own weight. The yarn receiving portion 247 of the rod 246 is normally positioned at the first position where it is held below the yarn passage between the split drum 6 and the suction nozzle 209 without its contracting the yarn during the normal take-up operation. However, when the push rod 241 is pushed, the rod 246 is displaced upward so that the yarn receiving portion 247 contacts the yarn portion 11*c* and urges it upwardly. Consequently, the yarn portion 11*c* can be more easily picked up by the fresh bobbin 7*a*. In the above-mentioned embodiment, it is preferable to provide a friction surface such as a brush surface, etc., on the yarn receiving portion 247 of the rod 246. This is because, if the yarn portion 11*c* is caught by the brush on the yarn receiving portion 247 while the end of yarn portion 11*c* is being sucked into the suction nozzle 209, the displacement of yarn portion 11*c* into the suction nozzle 209 is prevented, in addition the yarn portion 11*a* continuously supplied from the delivery rollers 4 and 5 is relieved of tension between the point where the split drum 6 contacts the fresh bobbin 7*a* and the yarn receiving portion 247 of the rod 246. As a result the slackened portion of the yarn 11*a* can be easily wound on the fresh bobbin 7*a*. After this initial winding operation, the cutting device 218 is actuated to cut the yarn portion 11*c* between the receiving portion 247 of the rod 246 and the suction nozzle 209, so that the cut-end portion of the yarn portion 11*c* is taken up by the fresh bobbin 6.

In the modified embodiment shown in FIG. 23, the yarn receiving portion 247 is provided with a yarn collecting guide portion 247*a* whereby a transfer tail wind 11*i* can be easily formed at the end portion of the fresh bobbin 7*a*. In this embodiment, the positions of the slit 216, suction nozzle 209 and the cutting device 218 are in line with the position of the yarn collecting guide portion 247*a*. However, the functions of these elements are quite similar to the embodiment shown in FIG. 17, except that the time of actuation of the cutting device 218 is just after the forming of the above-mentioned transfer tail wind 11*i* on the fresh bobbin 7*a*.

In the modified embodiment shown in FIG. 21, the cutting device 218 of the previous embodiment is omitted, and the suction nozzle 209 is given the function of severing the yarn portion 11*c*. The suction nozzle 209 is provided with an aperture 248 formed below the top of the nozzle. The aperture 248 opens into suction nozzle 209 along a tangential direction to the inside cylindrical wall of nozzle 209 as shown in FIG. 22.

Therefore, a rotating air current is created in the nozzle which rotates about the longitudinal axis of the suction nozzle 209. According to the above-mentioned rotating air current, the yarn portion 11*c* is turned toward its untwisting state so that individual fibers of the yarn portion 11*c* are liberated and sucked into the nozzle 209. Consequently, in spite of continuously introducing the yarn portion 11*c* into the suction nozzle 209, the length of yarn portion 11*c* in the nozzle 209 is maintained substantially constant. Under the above-mentioned condition, when the rod 246 is shifted upward so as to carry the yarn portion 11*c* upward by means of the yarn receiving portion 247, the end of the yarn portion 11*c* is pulled out of the suction nozzle 209. Therefore, the yarn portion 11*c* can be easily wound on the fresh bobbin 7*a*. If air is positively supplied into the suction nozzle 209 via the aperture 248, the above-mentioned untwisting of the yarn is carried out more effectively.

Next, the doffing operation by the above-mentioned second embodiment is illustrated with reference to the basic second embodiment shown in FIG. 12 through FIG. 14.

As in the case of the first embodiment, a fresh bobbin 7*a* is inserted into the bobbin holder 228. Upon forming a full yarn package 8, the doffing operation is commenced. (FIG. 12)

The operator turns the cradle 213 upward and takes off the full yarn package 8 from the cradle 213 so that the full yarn package 8 rolls along the guide plate 215 and is received by the conveyor belt 12. According to the above-mentioned doffing motion, the yarn 11 passes through the slit 216 (not shown) and is sucked into the suction nozzle 209. The cradle 213 is turned to its uppermost position and the fresh bobbin 7*a* which is being held by the bobbin holder 228 is grasped by the bobbin catcher (not shown) of the cradle 213 in a manner similar to the first embodiment. (FIG. 13)

When the cradle 213 is turned toward the split drum 6, the fresh bobbin 7*a* is released from the bobbin holder 228 and held only by the bobbin catcher of the cradle 213. Upon contact of the fresh bobbin 7*a* with the split drum 6, as the cutting devices 217 and 218 are actuated, the cut piece of yarn 11*d* (FIG. 14) in the suction nozzle 209 is sucked into the suction duct 210, while the yarn portion 11*c* is wound on the fresh bobbin 7*a* so that the winding operation on the fresh bobbin 7*a* is commenced. (FIG. 14)

In the above-mentioned two embodiments, the suction nozzle is utilized for forming a yarn passage at a position in front of a part of the peripheral surface of the friction roller 6 by which the yarn 11 passes during the normal taking-up operation. However, a conventional waste roller may be utilized instead of the suction nozzle.

In the third embodiment shown in FIGS. 24, 25, 26, 27, 28, 29 and 30, the cradle 313 is capable of holding an end of the yarn delivered from the delivery rollers and cutting the yarn connected to a full yarn package which has been doffed from the take-up mechanism. The end of yarn delivered from the delivery rollers is then automatically wound on a fresh bobbin 7*a* which is rotatably mounted on the cradle.

Figure 24:
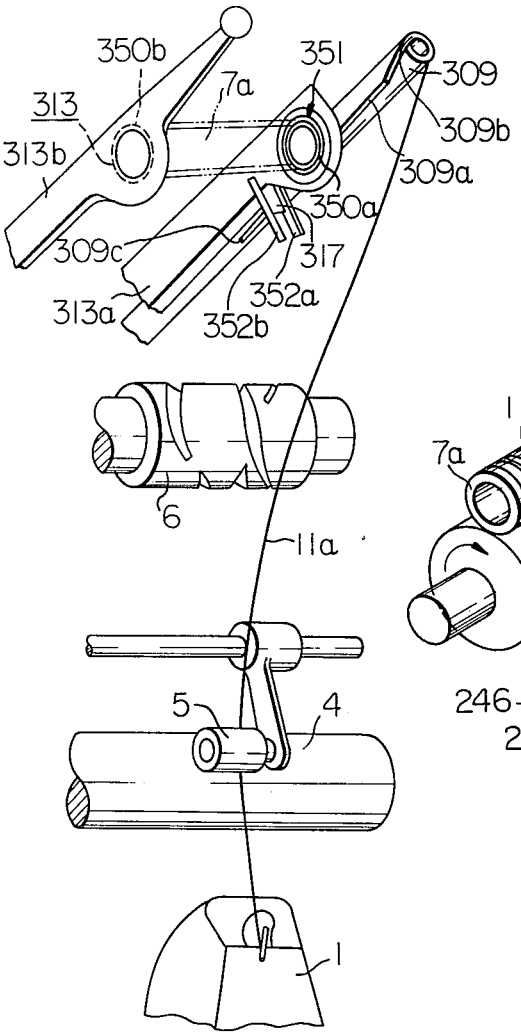
FIG. 24 is a perspective view of a third embodiment according to the present invention.
Figure 29:
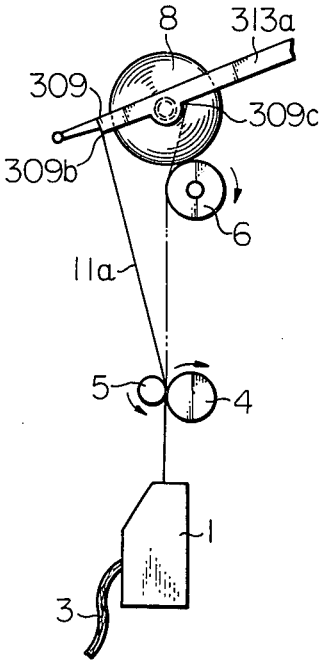
FIG. 29 is a schematic side view of a part of the third embodiment showing the yarn being introduced into the entrance to a slit formed in an arm and then introduced to a terminal of the slit.
Figure 30:
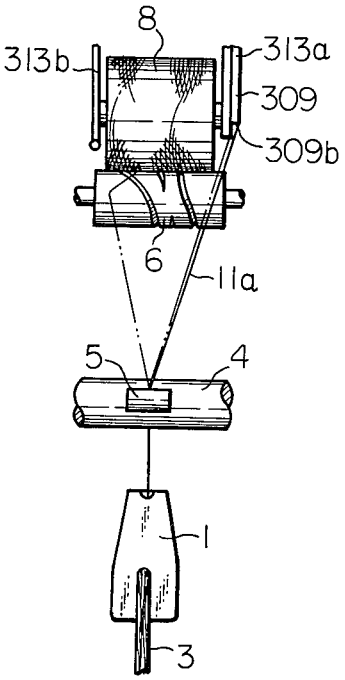
FIG. 30 is a schematic front elevational view of the apparatus shown in FIG. 25.

Referring to FIG. 24, the cradle 313 comprises a pair of cradle arms 313*a*, 313*b*. The cradle arm 313*a* does not have a handle as does arm 313*b* and is provided with a suction nozzle 309 which holds the yarn. The suction nozzle 309 is provided with a slit 309*a* which extends from a front free end thereof toward a position beyond and adjacent the bobbin carrier (not shown) of the cradle 313*a*. The nozzle 309 sucks the yarn portion 11*a* delivered from the delivery rollers 4 and 5 during the doffing and donning operation. The slit 309*a* carries the cut-end portion of the yarn 11*a* which is connected to the yarn being delivered from the delivery rollers 4 and 5 to a position where the yarn 11*a* is wound on the fresh bobbin 7*a*. The slit 309*a* is provided with a particular shape to achieve this. Specifically an upstream terminal 309*b* of the slit 309*a* is located at the bottom portion of the aperture of the nozzle 309 so as to prevent the introduction of the yarn 11*a* into the slit 309*a* at the beginning of the operation. After doffing a full yarn package 8 and the holding of a fresh bobbin 7*a* in the cradle 313, the operator introduces the yarn 11*a* into the slit 309*a* manually and carries the yarn 11*a* from the upstream terminal 309*b* to a downstream terminal 309*c* of the slit 309*a*. As shown in FIGS. 29 and 30, if the yarn 11*a* is carried to the downstream terminal 309*c* while the full yarn package 8 is being held by the cradle arms 313*a*, 313*b*, the yarn 11*a* is automatically introduced into the contact line between the split drum 6 and the full yarn package 8. Consequently, the yarn 11*a* is introduced into a transverse groove of the split drum 6 so that the yarn 11*a* is wound on the full yarn package 8. To prevent this it is necessary to select the time at which the yarn 11*a* is introduced into the downstream terminal 309 *c* of the slit 309*a* to be the time when winding on a fresh bobbin 7*a* is commenced.

Figure 31:
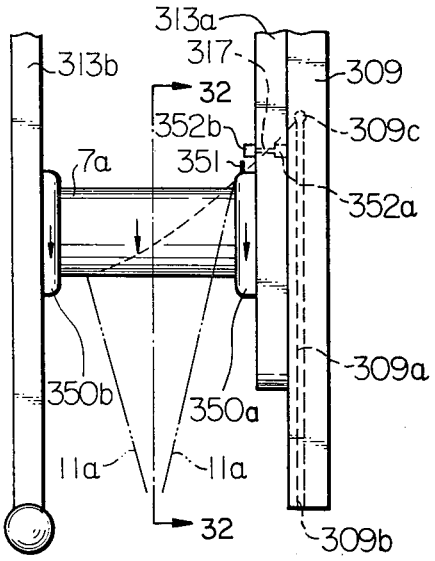
FIG. 31 is a schematic front elevational view of a part of the third embodiment wherein the situation just before cutting the yarn is shown.
Figure 32:
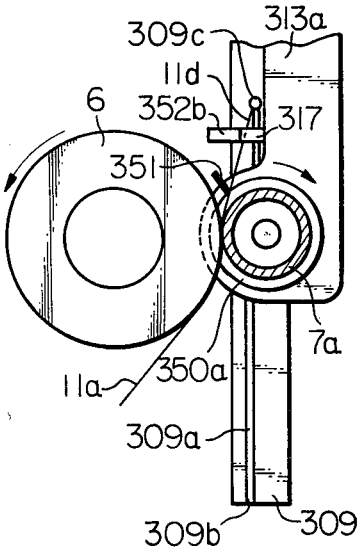
FIG. 32 is a sectional view of the apparatus shown in FIG. 31, taken along a line 32—32 in FIG. 31.
Figure 33:
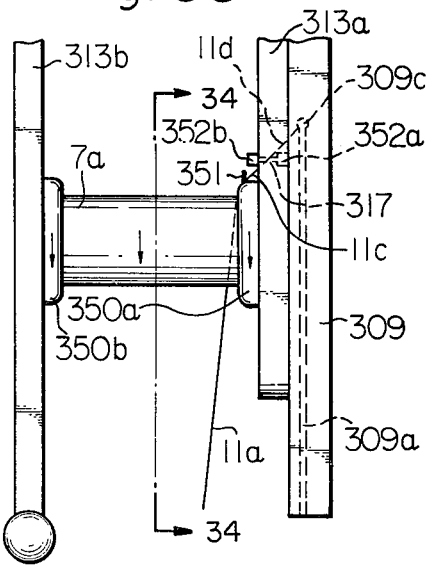
FIG. 33 is a schematic front elevational view of a part of the third embodiment wherein the situation just after cutting the yarn is shown.
Figure 34:
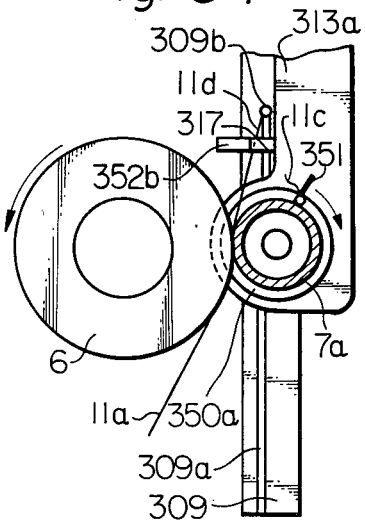
FIG. 34 is a sectional view of the apparatus shown in FIG. 33, taken along a line 34—34 in FIG. 33.

The detailed construction and function of the third embodiment according to the present invention is hereinafter explained in detail. The bobbin catchers 350*a*, 350*b* are mounted on the cradle arms 313*a*, 313*b*, respectively. These bobbin catchers 350*a*, 350*b* have a construction similar to the first embodiment. A yarn catching pin 351 is rigidly mounted on the bobbin catcher 350*a* at a position on the outside peripheral surface as shown in FIGS. 31, 32. A cutter 317 is mounted on the cradle arm 313*a* and provided with a sharp knife edge on its bottom and a pair of guide pieces 352*a* and 352*b* adjacent the two outside positions of the cutter 317. The relative arrangement of these elements (the slit terminal 309*c*, cutter 317 and the pin 351) are shown in FIGS. 31, 32, 33 and 34. When the cradle arm 313*a* is turned upward, the yarn 11*a* does not contact the knife edge of the cutter 317. However, when the cradle arm 313*a* is turned downward and a fresh bobbin 7*a* comes into contact with the split drum 6, the yarn 11*a* introduced into the slit terminal 309*c* is introduced into a space between the guide pieces 352*a* and 352*b* and is caught by the pin 351.

Consequently, the yarn 11*a* is urged against the knife edge of the cutter 317 so that the yarn 11*a* is severed. The cut end 11*c* of the yarn 11*a* on the split drum 6 side is wound on the fresh bobbin 7*a* while being held by the pin 351. The cut ends 11*d* of the yarn 11*a* on the slit 309*a* side is sucked into the nozzle 309. A bobbin holder 328 (FIG. 28) is mounted on a bracket (not shown) secured to a frame of a spinning unit, the construction and function of the bobbin holder 328 being quite similar to the first and second embodiments. Therefore, when the cradle arms 313*a*, 313*b* are turned upward to their terminal position, a fresh bobbin 7*a*, which is being held by the bobbin holder 328, is also grasped by the bobbin catchers 350*a*, 350*b*. When the cradle arms 313*a*, 313*b* commence to turn downward, the fresh bobbin 7*a* is released from the bobbin holder 328 and held only by the cradle arms 313*a*, 313*b*. In this embodiment, a guide plate 315 is mounted as in the first and second embodiments so as to guide the full yarn package 8 toward the conveyor belt 12. A suction duct 310 (FIG. 25) is connected to the suction nozzle 309 by way of a flexible hose. The suction duct 310 may be actuated just before the doffing and donning operation.

Next, the doffing and donning operation of the third embodiment is hereinafter explained.

Figure 25:
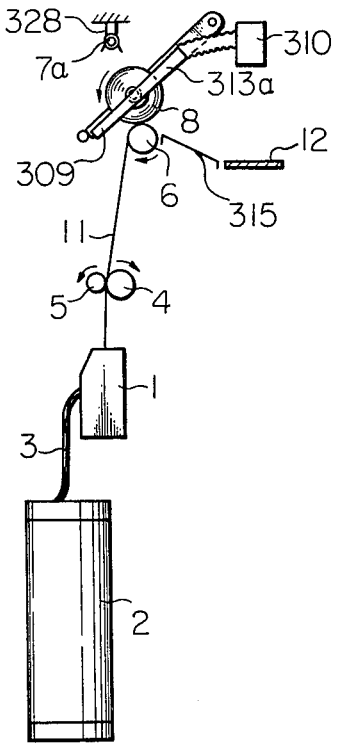
FIG. 25 through FIG. 28 are schematic side views of the third embodiment, showing steps of a doffing operation and a donning operation.

Before a full yarn package 8 is formed, a fresh bobbin 7*a* is inserted into the bobbin holder 328. And when a full yarn package 8 is formed, the doffing operation is commenced. (FIG. 25)

Figure 26:
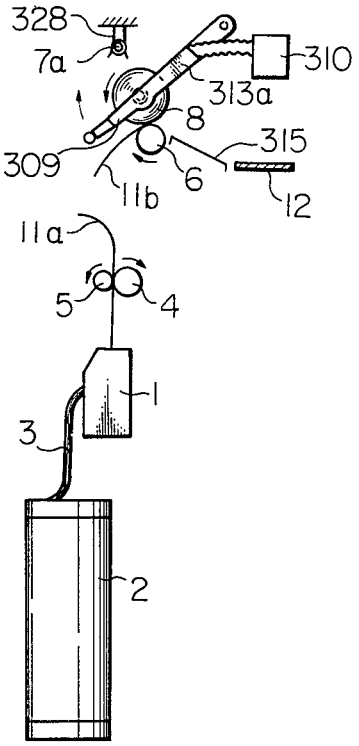

The operator cuts the yarn 11 at a position between the delivery rollers 4 and 5 and the split drum 6. The above-mentioned cutting operation is carried out manually or by utilizing a suitable cutting device. The yarn portion 11*a* which is continuously being delivered from the delivery rollers 4 and 5 is held by hand while the yarn portion 11*b* on the split drum side is wound on the full yarn package 8. (FIG. 26)

Figure 27:
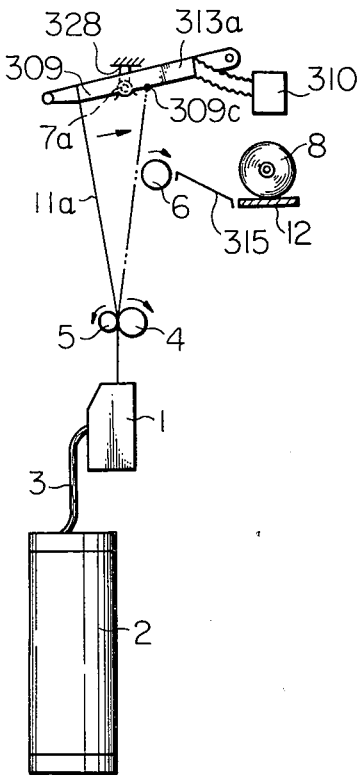

The yarn portion 11*a* held by hand is introduced into the suction nozzle 309 and the cradle arms are turned upward. During the above-mentioned upward turning motion of the cradles, the full yarn package 8 is manually pushed out from the bobbin catchers 350*a*, 350*b* so that the full yarn package 8 rolls along the guide plate 315 to the conveyer belt 12. Upon arrival of the cradle arms 313*a*, 313*b* at the terminal of their upward motion, the fresh bobbin 7*a* held by the bobbin holder 328 is automatically grasped by the bobbin catchers 350*a*, 350*b*. Thereafter, the yarn portion 11*a* is introduced to the slit terminal 309*c*. In the above-mentioned condition, the yarn portion 11*a* passes beyond the part of peripheral surface of the split drum 6 which is contacted by bobbin 7*a* or a yarn package during the normal taking up operation. (FIG. 27)

Figure 28:
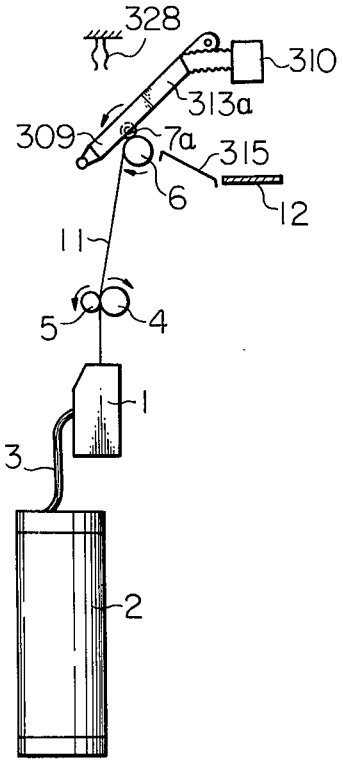

When the operator turns the cradle arms 313*a*, 313*b* downward toward the split drum 6, the yarn portion 11*a* is pushed by the fresh bobbin 7*a* toward the split drum 6, and simultaneously the yarn portion 11*a* is cut by the cutter 317. The yarn which is delivered from the delivery rollers 4 and 5 is wound on the fresh bobbin 7*a* which is rotating by the frictional contact with the split drum 6 as described hereinbefore. The full yarn package 8 received by the conveyor belt 12 is carried outside the open-end spinning machine. (FIG. 28)

What is claimed is:

1. In an apparatus for doffing and donning in a textile machine having a spinning unit, a take up unit having a rotatably driven friction roller, a pivotably mounted cradle for releasably holding a bobbin in contact with said friction roller for rotating said bobbin with said friction roller, and delivery means mounted spaced from one side of said friction roller for continuously directing yarn from said spinning unit, whereby yarn from said spinning unit may be wound on a bobbin held in said cradle; the improvement wherein said cradle is manually pivotably movable toward and away from said friction roller, comprising a bobbin holder mounted in a fixed position with respect to said friction roller and including means for releasably holding fresh bobbins in the path of pivotal movement of said cradle away from said friction roller, said cradle having holding means for grasping a fresh bobbin held by said bobbin holder when said cradle is pivotally moved away from said friction roller, and means comprising a suction nozzle forming a temporary yarn passage, said suction nozzle being positioned on the same side of said friction roller as said delivery means to receive yarn from said delivery means and hold it out of contact with said friction roller, said friction roller and said bobbin holder being located on opposite sides of the yarn when the yarn is received by said suction means whereby, upon pivotal movement of said cradle from said bobbin holder toward said friction roller with a fresh bobbin held therein, yarn extending between said delivery means and said suction nozzle may be urged into contact with said friction roller for being wound on said fresh bobbin.

2. The apparatus of claim 1 wherein said suction nozzle is fixedly mounted.

3. The apparatus of claim 2 wherein the pivotal axis of said cradle is on the side of said friction roller opposite said one side.

4. The apparatus of claim 1 wherein said delivery means is mounted below and to one side of said friction roller, said suction nozzle is mounted in a fixed position above said friction roller, and said bobbin holder is fixedly mounted above said friction roller at the side of said suction nozzle.

5. The apparatus of claim 4 wherein said cradle is pivotally mounted for rotation about an axis at the side of said friction roller away from said one side.

6. The apparatus of claim 1 wherein said bobbin holder comprises means for resiliently holding a fresh bobbin between its axial ends, and said cradle comprises a pair of arms, and bobbin holding means resiliently mounted in each of said arms for engaging the axial ends of a fresh bobbin held in said bobbin holder.

7. The apparatus of claim 1 wherein said suction nozzle is mounted on said cradle.

8. The apparatus of claim 1 wherein said cradle comprises first and second arms mounted for pivotal movement in common about a common axis, said suction nozzle being mounted on said first arm for movement therewith.

9. The apparatus of claim 8 wherein said nozzle comprises an open end of said first arm.

10. The apparatus of claim 9 wherein said holding means on said cradle comprises means for resiliently holding a bobbin between said first and second arms and spaced from said open end of said first arm.

11. The apparatus of claim 10 wherein said suction nozzle further comprises a slit extending from said open end and past said holding means on said first arm, and further comprising cutting means positioned to cut yarn extending in said slit in the region thereof past said holding means.

12. The apparatus of claim 11 wherein said holding means are rotatably held in said arms, and further comprising a pin on said holding means on said first arm positioned to engage yarn extending into the end of said slit past said holding means for urging said yarn to contact said cutting means.

13. The apparatus of claim 1 further comprising auxiliary means for discharging a full yarn package from said take up unit, said auxiliary means comprising a guide plate positioned adjacent said friction roller on the side thereof opposite said one side, said guide plate being inclined whereby a full yarn package urged thereonto from said cradle rolls away from said take-up unit.

14. The apparatus of claim 13 further comprising a conveyor belt disposed adjacent said guide plate for receiving a full yarn package from said guide plate.

15. The apparatus of claim 9 further comprising an operating handle on said second arm.

* * * * *